US010541476B1

(12) United States Patent
West et al.

(10) Patent No.: US 10,541,476 B1
(45) Date of Patent: Jan. 21, 2020

(54) SPHERICAL SPACE FEED FOR ANTENNA ARRAY SYSTEMS AND METHODS

(71) Applicant: Rockwell Collins, Inc., Cedar Rapids, IA (US)

(72) Inventors: James B. West, Cedar Rapids, IA (US); Jeremiah D. Wolf, Atkins, IA (US); Aimee M. Matland, Cedar Rapids, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 166 days.

(21) Appl. No.: 15/674,475

(22) Filed: Aug. 10, 2017

(51) Int. Cl.
*H01Q 21/00* (2006.01)
*H01Q 3/46* (2006.01)

(52) U.S. Cl.
CPC ..... *H01Q 21/0018* (2013.01); *H01Q 3/46* (2013.01)

(58) Field of Classification Search
CPC .... H01Q 21/0018; H01Q 3/46; H01Q 13/085; H01Q 19/062; H01Q 1/38
See application file for complete search history.

(56) References Cited

U.S. PATENT DOCUMENTS 6,421,021 B1 * 7/2002 Rupp ..... H01Q 13/085 343/753
2007/0195004 A1 * 8/2007 Rebeiz ..... H01Q 1/3233 343/876

* cited by examiner

*Primary Examiner* — Robert Karacsony
(74) *Attorney, Agent, or Firm* — Donna P. Suchy; Daniel M. Barbieri

(57) ABSTRACT

An antenna array system includes a feed antenna and circuit boards. Each circuit board has pickup antenna elements disposed on a curved edge portion of a first edge of the circuit board, radiating elements disposed on a second edge portion of the circuit board, and transmit receive modules disposed between the pickup elements and the radiating elements on the circuit board. The antenna array can be part of an active electronically scanned array (AESA) antenna assembly.

20 Claims, 6 Drawing Sheets

SPHERICAL SPACE FEED FOR ANTENNA ARRAY SYSTEMS AND METHODS

BACKGROUND

Embodiments of inventive concepts disclosed herein relate the field of antenna arrays including but not limited to, phased array antenna systems or electronically scanned array (ESA) antenna systems, such as active electronically scanned array (AESA) antenna systems having space feeds.

Antenna arrays can provide improved antenna performance by allowing control of phase (or relative time delay) and relative amplitude of the signal associated with each antenna element in an antenna array. By adjusting signal phase and/or relative amplitude of separate antenna elements, information redundancy in signals associated with distinct antenna elements can be used to form a desired beam signal. Space feeds can be used to provide a radiative wireless connection between a single feed point radiator and each channel or antenna element of an AESA. Conventional space feeds can be used to achieve lower radiated side lobe levels from an antenna array at the expense of aperture gain and feed spillover loss (by extension, illumination efficiency).

SUMMARY

In one aspect, embodiments of the inventive concepts disclosed herein are directed to antenna array system including a feed antenna and circuit boards. Each circuit board has pickup antenna elements disposed on a curved edge portion of a first edge of the circuit board, radiating elements disposed on a second edge portion of the circuit board, and transmit receive modules disposed between the pickup elements and the radiating elements on the circuit board.

In some embodiments, each transmit/receive module can include one or more amplifiers and one or more phase-shifters configured to control amplitudes and phases, respectively, of signals associated with an array of antenna elements of a corresponding metallic structure coupled to a printed circuit board. In some embodiments, the array of antenna elements can have a frequency bandwidth that includes at least the frequency range between 18 GHz and 60 GHz.

In another aspect, embodiments of the inventive concepts disclosed herein are directed to method of manufacturing an array antenna. The method includes providing circuit board cards having first metallization layer traces configured as pickup antennas and second metallization layer traces configured as radiation antennas, and providing a feed antenna proximate a first edge of the cards. The first edge is associated with the pickup antennas, and the pickup antennas are arranged in a curved fashion.

In some embodiments, the antenna elements in each sheet metal structure are physically formed using laser cutting or chemical etching. In some embodiments, the one or more alignment structures can include the at least one electromagnetic shielding structure. In some embodiments, each printed circuit board includes one or more amplifiers and one or more phase-shifters (or time delay elements) configured to control amplitudes and phases (or delay), respectively, of signals associated with antenna elements.

In another aspect, embodiments of the inventive concepts disclosed herein are directed to a spherical space feed for an antenna array assembly. The spherical space feed includes at least one circuit board comprising pickup antenna elements disposed in a curved fashion at a first edge of the circuit board, radiating antenna elements disposed on a second edge of the circuit board, and transmit receive modules disposed between the pickup antenna elements and the radiating antenna elements on the circuit board. The first edge is opposite the second edge.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
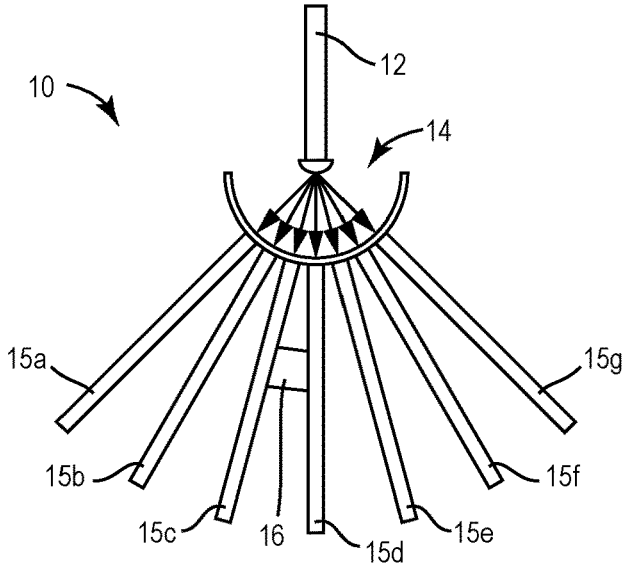
FIG. 1 is a schematic top view planar drawing of an AESA assembly including cards with pickup antennas and radiating antennas according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

According to certain aspects of inventive concepts, systems and methods provide a space feed for an antenna assembly (e.g., an AESA assembly or a Vivaldi assembly). Space feeds provide a wireless interconnect between a single point feed radiator and each channel of the AESA in some embodiments. Stripline and microstrip connectorized corporate feed manifolds can have high loss at millimeter frequencies. Such losses severely complicate AESA design for electrically large arrays, particularly affecting signal to noise ratio (SNR) without large amounts of amplification. Large amounts of amplification increases size, weight, cost and power and require increased AESA thermal management. Further, at high frequencies (e.g., 20-44 gigahertz), the connector size can prevent appropriate spacing (at half wavelengths apart) for the array to perform adequately as a scanning array structure.

In some embodiments, a primary AESA aperture is configured as a "sampled lens" with receive pickup antenna elements that each feed a respective transmit/receive module TRM and a respective primary radiating element of the AESA. The pickup and primary radiating elements are identical in some embodiments. In some embodiments, the pickup and primary radiating elements are not identical. The stencil antenna technology described in U.S. patent application Ser. No. 15/048,969 incorporated herein by reference in its entirety is used to provide a lens array compatible with the space feed technology as described herein.

In some embodiments, systems and methods provide spherical phased array space feeds using transmit-receive modules (TRMs) as described in one or more of U.S. patent application Ser. Nos. 13/714,209, 14/300,074, 14/300,055, and 14/300,021, and U.S. Pat. No. 9,653,820, all incorporated herein by reference in their entireties in some embodiments. The term transmit/receive module (TRM) refers to a circuit including at least one active integrated circuit for performing phase shifting and amplification in a receive path, a transmit path or a transmit/receive path. The TRM can operate as a receive only module, a transmit only module, or as a combined transmit receive module in some embodiments.

The spherical phased array space feeds collect the naturally spherical propagating electromagnetic (EM) wave from the primary feed on a spherical "pickup antenna array" to minimize spill over loss in some embodiments. The primary feed antenna provides a nearly omnidirectional radiation pattern in its forward hemisphere in some embodiments. The spherical phased array space feed can be used with planar, cylindrical, semi-cylindrical, single curved, spherical, hemispherical, and doubly curved apertures in some embodiments.

Ultra-wideband (UWB) steerable antenna arrays using space feed technology can be used in a variety of applications including but not limited to: wireless communications, remote sensing, biological or medical microwave imaging, aviation applications, military applications, and/or the like. The UWB steerable antenna arrays can include, but are not limited to, phased-array antenna systems or electronically scanned array (ESA) antenna systems, such as active electronically-scanned array (AESA) antenna systems. The UWB steerable antenna array systems operate at frequency bandwidths within 2 to 40 GHz.

UWB steerable antenna array systems can be manufactured using thin metal planar antenna elements as described in U.S. patent application Ser. No. 15/048,969 incorporated herein by reference in its entirety and assigned to the assignee of the present application in some embodiments. A UWB steerable antenna array system can include a plurality of thin metal structures (or sheet metal structures), each of which represents a one-dimensional (1-D) array of thin metal planar antenna elements. Using manufacturing processes such as laser cutting, chemical etching, or electroforming, sheet metal structures with high resolution (or dimensionally precise) planar antenna elements can be manufactured at a relatively low cost. For example, the accuracy of laser cutting is within ±5 micrometers (μm). The sheet metal structures can be arranged substantially parallel to one another to form a two-dimensional (2-D) array of thin metal planar antenna elements. Each thin metal structure can be mechanically and electrically coupled to a respective printed circuit board (PCB). The sheet metal structures can be mechanically coupled to each other using one or more alignment structures. In some embodiments, the UWB steerable antenna array system can include at least one electromagnetic shielding structure for shielding one or more active/electronic circuit components from electromagnetic radiations associated with the planar antenna elements, and/or the planar antenna elements from electromagnetic radiations associated with the one or more active/electronic circuit components.

With reference to FIG. 1, an antenna array, embodied as an AESA assembly 10, includes a feed antenna 12 and a number of cards 15*a-g*. The number of cards 15*a-g* can be any number and can be provided in various physical arrangements and orientations. As shown in FIG. 1, the AESA assembly 10 includes a spherical space feed pickup 14.

The cards 15*a-g* are provided in a configuration and can be separated from each other by a support member 16. The support member 16 is a wedged shaped structure provided between the cards 15*c* and 15*d* in FIG. 1 but can be provided between any number of the cards 15*a-g*. The support member 16 is anti-blow-by wedges in some embodiments. The anti-blow by wedges are designed to prevent parasitic feed radiation not received by cards 15*a*-15*g* to radiated between the cards 15*a*-15*g*. The support member 16 provides a receptacle or interface for mounting and spacing the cards 15*a-g* for the AESA assembly 10. In some embodiments, the support member 16 is part of a chassis between the cards 15*a-g* to extinguish primary feed RF blow-by and facilitate mechanical assembly. In some embodiments, the cards 15*a-g* plug into a spherical metal cap.

The AESA assembly 10 is shown as a vertical polarization (VP) array arrangement but can be rotated 90 degrees for a horizontal polarization (HP) array arrangement in some embodiments. The AESA assembly 10 is arranged as a partial cylindrical array, having an azimuth of approximately 90 degrees, in some embodiment. The cards 15*a-g* are provided in a full cylindrical array arrangement or any portion thereof and are evenly spaced apart in some embodiments. The cards 15*a-g* can be arranged at other spacings and in other shapes.

The feed antenna 12 is a device for providing EM to the cards 15*a-g* or receiving EM from the cards 15*a-g*. The feed antenna 12 includes a cylindrical or spherical antenna element in some embodiments. The feed antenna 12 is disposed proximate the cards 15*a-g*. The feed antenna is a horn antenna or any type of antenna or set of antennas the have the appropriate beam width. The feed antenna 12 can be a low-gain antenna, an open-ended wave guide, a physically short horn, a dipole, cross-dipole, a micro strip patch, or a spiral antenna in some embodiments. The feed antenna 12 has sufficient gain and bandwidth to illuminate the spherical space feed pickup 14 in some embodiments.

Figure 2:
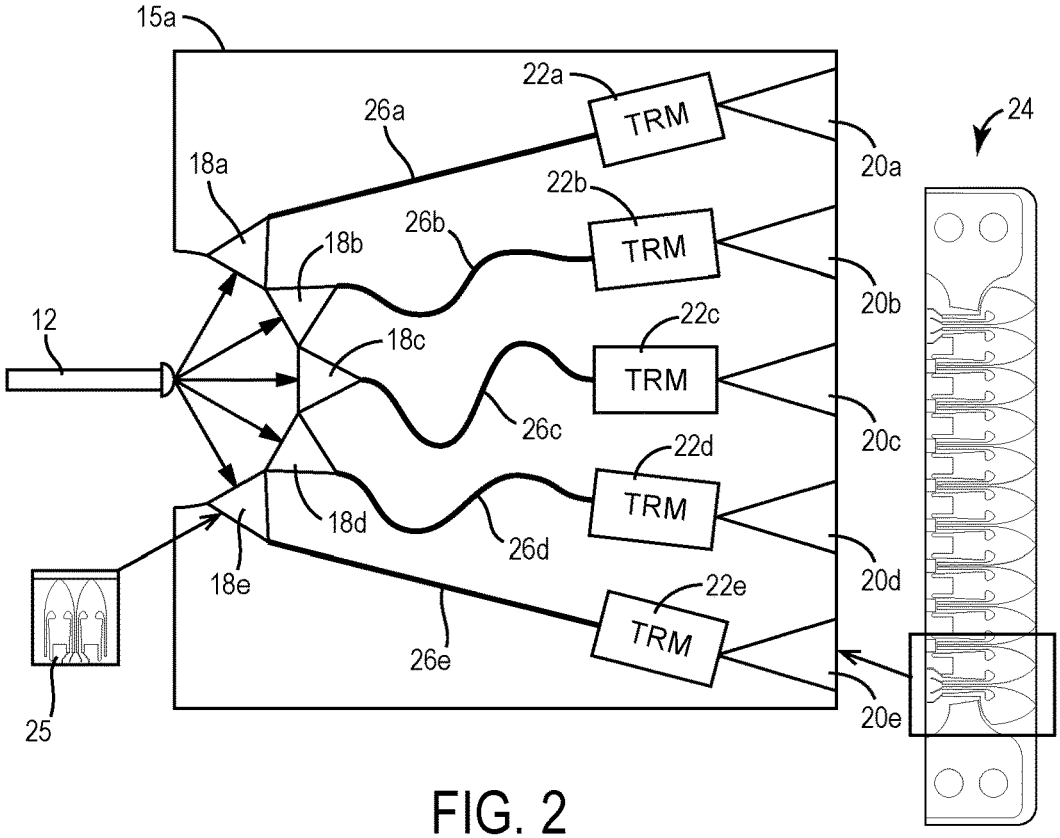
FIG. 2 is a schematic front view planar drawing of one of the cards illustrated in FIG. 1 according to exemplary aspects of the inventive concepts disclosed herein.

With reference to FIGS. 1 and 2, a card 15*a* which is similar to cards 15*b-g* includes pickup antenna elements 18*a-e* and radiating antenna elements 20*a-e*. The card 15*a* also includes transmit receive modules (TRMs) 22*a-e* corresponding to the pickup antenna elements 18*a-e* and radiating antenna elements 20*a-e*, respectively. The card 15*a* serves as a cross section of a generally conformal AESA lens radiating element.

The card 15*a* is a printed circuit board structure card housing the antenna elements 18*a-e* and 20*a-e* in some embodiments. The radiating antenna elements 20*a-e* can be provided as part of a structure 24 embodied as a metallic structure. In some embodiments, the radiating elements 18*a-e* are on a common stencil card such as the structure 24. Similarly, the pickup antenna elements 18*a-e* can be provided as a metallic structure 25 (e.g., sheet metal) and are provided on a common stencil card. In some embodiments, the pickup antenna elements 18*a-e* and the radiating antenna elements 20*a-e* are printed circuit board conductors disposed on cards 15*a-g* embodied as printed circuit boards. The antenna elements 18*a-e* are arranged in a semi-circle on a curved edge 28 of the card 15*a* to facilitate efficient RF energy transfer between feed antenna 12 and pick up antennas 18*a*-18*e*.

The structures 24 and 25 include a thin metal antenna array and include metallic structures arranged substantially parallel or in a curved fashion with respect to one another. While the antenna elements 18*a-e* and 20*a-e* are schematically shown as triangular or bullet shaped structures, various shapes and sizes can be utilized. The antenna elements 18*a-e* and 20*a-e* are made of a conductive metal or alloy such as stainless steel, copper, brass, or any other conductive metal or alloy or are printed circuit board pads of copper or copper alloy in some embodiments.

Each card 15*a-g* can be mechanically and electrically coupled to sheet metal structures 25 and 24 for the respective elements 18*a-e* and 20*a-e*. Each metallic structure 24 and 25 can be fully integrated or partially integrated in (25 or partially blended with) a respective printed circuit board card associated with the cards 15*a-g*. In particular, a portion of the metallic structure can be soldered, welded or otherwise attached to the respective printed circuit board such that the radiating antenna elements 20*a-e* extend beyond the printed circuit board, for example, along (or parallel to) a plane representing a planar surface of the printed circuit board. In some embodiments, each metallic structure can be mechanically coupled (e.g., soldered or welded) to a respective printed circuit board such that the radiating antenna elements 20*a-e* of that sheet metal structure extend beyond the respective printed circuit board along a plane perpendicular to the card 15*a*. The pickup antenna elements 18*a-e* can be similarly disposed. The antenna card assemblies can also be realized through non-traditional manufacturing techniques such as 3D additive manufacture, plated traces on plastic (dielectric substrate slabs, substrates made using injections molded plastic.

Connectors 26*a-e* corresponding to the TRMs 22*a-e*, antenna elements 18*a-e* and antenna elements 20*a-e* connect the TRMs 22*a-e* to respective antenna elements 18*a-e*. The connectors 26*a-e* are printed circuit board transmission lines in some embodiments, each having an equal length. Various printed transmission line configurations such as microstrip, stripline grounded coplanar waveguide, etc. are possible. In some embodiments, the TRMs 22*a-e* can be coupled directly to antenna elements 20*a-e* or coupled via additional connecting path transmission lines. The connectors 26*b-d* have a serpentine configurations to achieve equal lengths with connectors 26*a* and 26*e* in some embodiments.

Bias control and ground lines for the TRMs 22*a-e* can be provided in radio frequency (RF) benign areas of the cards 15*a-g* for the next level of interconnections. The TRMs 22*a-e* can be modules as described in U.S. patent application Ser. Nos. 13/714,209, 14/300,074, 14/300,055, and 14/300,021, and U.S. Pat. No. 9,653,820, all incorporated herein by reference in their entireties in some embodiments incorporated herein by reference. The TRMs 22*a-e* are devices that provide processing, amplification, conditioning, and phase (or delay) control for signals travelling between the antenna elements 20*a-e* and 18*a-e* in some embodiments.

Figure 3:
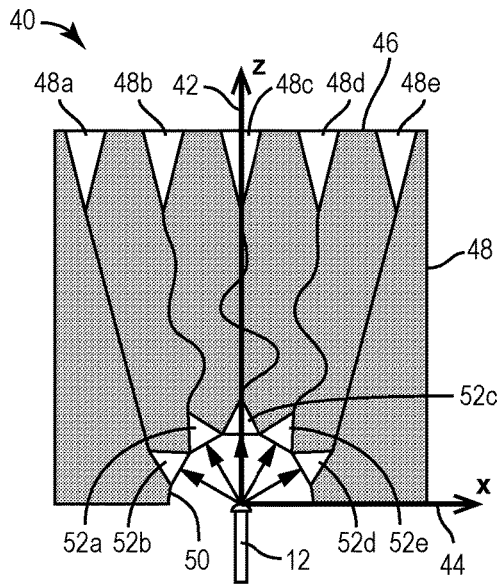
FIG. 3 is a schematic top view planar drawing of one of the cards for use in a horizontally polarized (HP) cylindrical AESA assembly where the cards are provided at varying angles about an X-axis according to exemplary aspects of the inventive concepts disclosed herein.

With reference to FIG. 3, a card 40 can be used as one of the cards 15*a-g* in the AESA assembly 10 (FIG. 1). The card 40 can be utilized as part of an HP cylindrical AESA assembly. The card 40 is arranged with other cards at varying angles about an x-axis 44. A z-axis 42 is provided in line with the feed antenna 12. The card 40 has a straight edge 46 associated with radiating elements 48*a-e* and a curved edge 50 associated with pickup antenna elements 52*a-e*.

Figure 4:
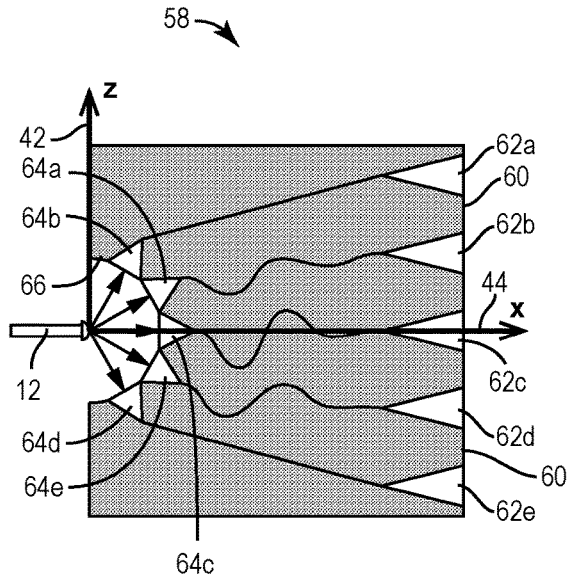
FIG. 4 is a schematic top view planar drawing of one of the cards for use in a vertically polarized (VP) cylindrical AESA assembly where the cards are provided at varying angles about a Z-axis according to exemplary aspects of the inventive concepts disclosed herein.

With reference to FIG. 4, a card 58 can be used as one of the cards 15*a-g* in the AESA assembly 10 (FIG. 1). The card 48 can be utilized as part of a VP cylindrical AESA assembly. The card 58 is arranged with other cards at a varying angle about the z-axis 42. The feed antenna 12 is provided in line with the x-axis 44. The card 58 has a straight edge 60 associated with the radiating antenna elements 62*a-e*. The pickup antenna elements 64*a-e* are provided along a curved edge 66.

Figure 5:
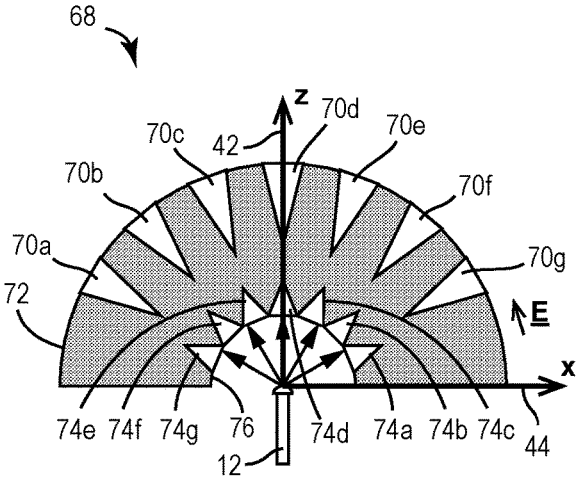
FIG. 5 is a schematic top view planar drawing of one of the cards for use in an HP hemispherical AESA assembly where the cards are provided at varying angles about an X-axis according to exemplary aspects of the inventive concepts disclosed herein.

With reference to FIG. 5, a card 68 can be used as one of the cards 15*a-g* in the AESA assembly 10 (FIG. 1). The card 68 along with other cards can be assembled about a varying angles about the x-axis 44 for an HP hemisphere AESA structure. The card 68 includes radiating antenna elements 70*a-e* along a curved edge 72. The pickup antenna elements 74*a-g* are provided along a curved edge 76. The curved edges 72 and 76 can be semi-circular edges differing from each other by a fixed radius. The electric (E) field component vector is disposed tangent to the edge 72 for the card 68 in some embodiments.

Figure 6:
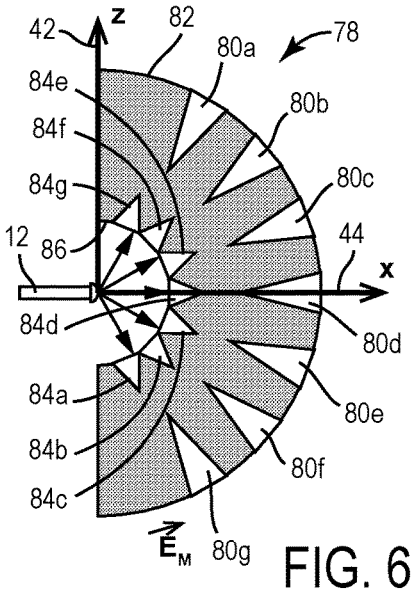
FIG. 6 is a schematic top view planar drawing of one of the cards for use in a VP hemispherical AESA assembly where the cards are provided at varying angles about a Z-axis according to exemplary aspects of the inventive concepts disclosed herein.

With reference to FIG. 6, a card 78 can be used as one of the cards 15*a-g* in the AESA assembly 10 (FIG. 1). The card 78 is similar to the card 68 and with other cards can be assembled at varying angles about the z-axis 42 as a VP hemisphere AESA structure. Radiating antenna elements 80*a-g* are provided along a curved edge 82 and pickup antenna elements 84*a-g* are provided along a curved edge 86. The electric field component ($E_m$) vector is disposed tangent of the edge 82. Curved edges 82 and 86 can be semi-circular edges differing from each other by a fixed radius.

Figure 7:
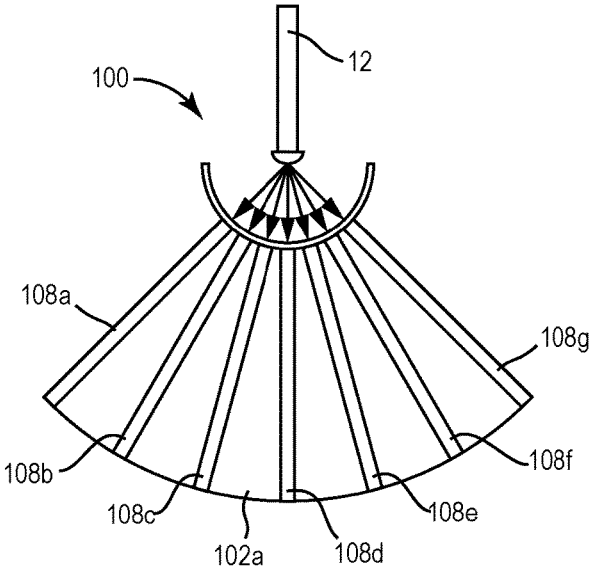
FIG. 7 is a schematic top view planar drawing of a dual linear polarization cylindrical AESA assembly according to exemplary aspects of the inventive concepts disclosed herein.
Figure 8:
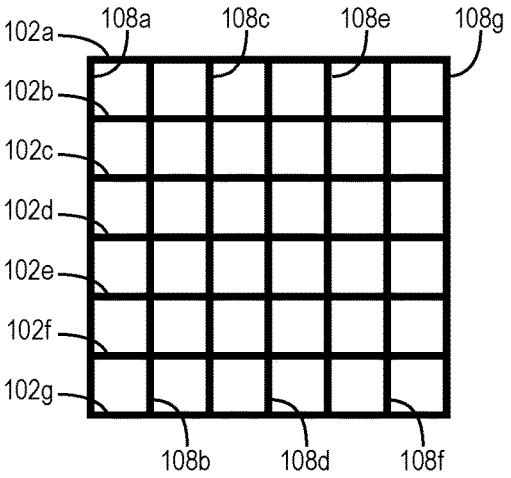
FIG. 8 is a schematic top view planar drawing of the dual linear polarization cylindrical AESA assembly illustrated in FIG. 7 according to exemplary aspects of the inventive concepts disclosed herein.

With reference to FIGS. 7 and 8, a dual linear polarization cylindrical AESA assembly 100 includes cards 102*a-g* and cards 108*a-g*. The cards 102*a-g* and cards 108*a-g* can have toothcomb notches for assembly. An egg crate sub-assembly can be provided for receiving the cards 102*a-g* and cards 108*a-g*.

Figure 9:
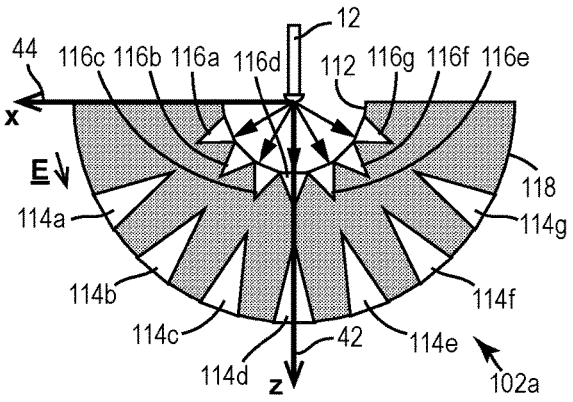
FIG. 9 is a schematic top view planar drawing of one of the cards of a first type polarization for use in the dual linear polarization cylindrical AESA assembly illustrated in FIG. 7 according to exemplary aspects of the inventive concepts disclosed herein.

With reference to FIG. 9, the card 102*a*, similar to the cards 102*b-f*, includes a curved edge 112 and a curved edge 118 associated with pickup radiating elements 116*a-g* and radiating antenna elements 114*a-g*, respectively. The E field component vector is disposed tangent to the edge 114.

Figure 10:
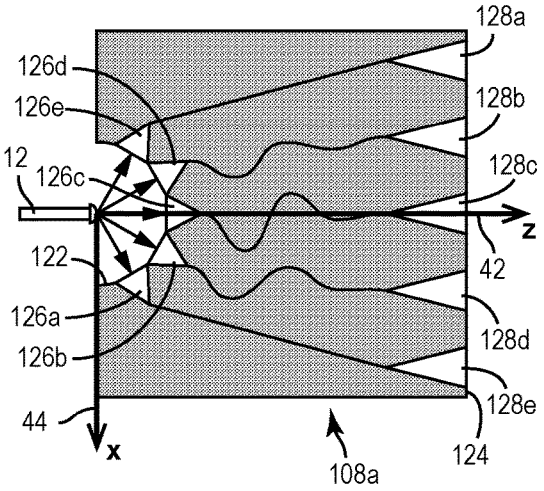
FIG. 10 is a schematic side view planar drawing of one of the cards of a second type polarization for use in the dual linear polarization cylindrical AESA assembly illustrated in FIG. 7 according to exemplary aspects of the inventive concepts disclosed herein.

With reference to FIG. 10, the card 108*a*, similar to the cards 108*b-f*, includes a curved edge 122 and a straight edge 124 associated with pickup antenna elements 126*a-e* and radiating elements 128*a-e*, respectively.

Figure 11:
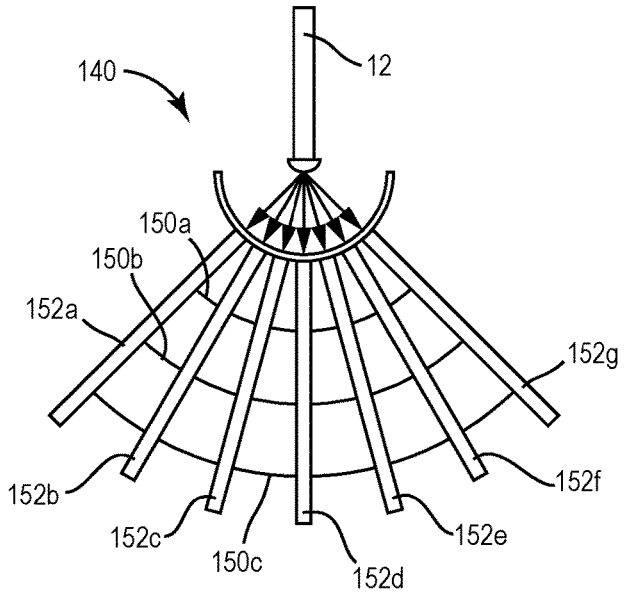
FIG. 11 is a schematic top view planar drawing of a dual linear polarization hemispherical AESA assembly according to exemplary aspects of the inventive concepts disclosed herein.

With reference to FIG. 11, a dual linear polarization hemispherical ASEA assembly 140 includes cards 150*a-c* and cards 152*a-g*. The AESA assembly 140 can utilize notches in the cards 152*a-g* and 150*a-c*.

Figure 12:
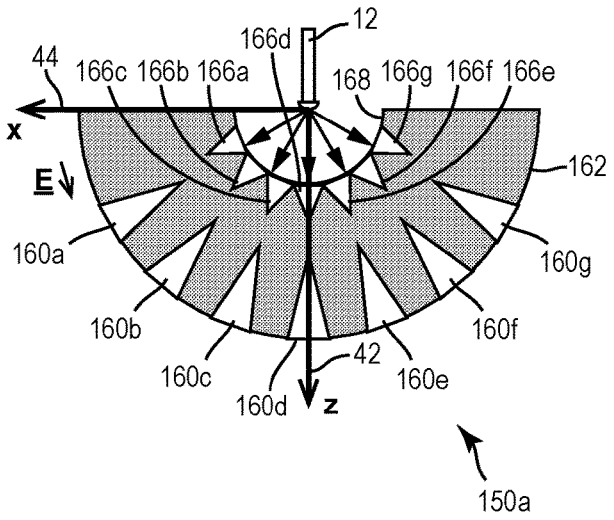
FIG. 12 is a schematic top view planar drawing of one of the cards of a first type polarization for use in the dual linear polarization hemispherical AESA assembly illustrated in FIG. 11 according to exemplary aspects of the inventive concepts disclosed herein.

With reference to FIG. 12, the card 150*a* is similar to the cards 150*b-c* which are provided at varying angles about the x-axis 44. The card 150*a* includes radiating antenna elements 160*a-f* along an edge 162 whose tangent is parallel with the E field. The pickup antenna elements 166*a-e* are provided along a curved edge 168.

Figure 13:
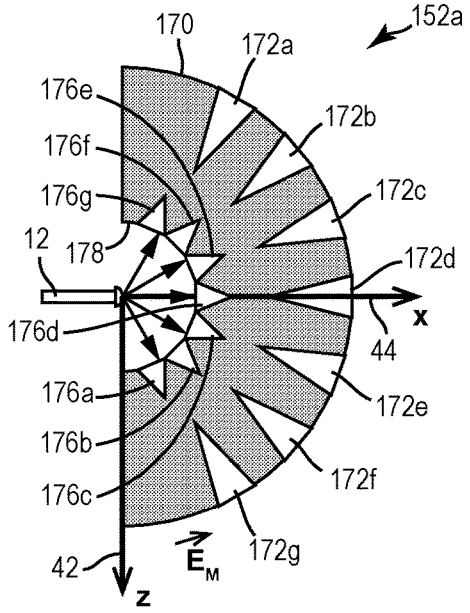
FIG. 13 is a schematic side view planar drawing of one of the cards of a second type polarization for use in the dual linear polarization hemispherical AESA assembly illustrated in FIG. 11 according to exemplary aspects of the inventive concepts disclosed herein.

With reference to FIG. 13, the card 152*a* which is similar to the cards 152*b-e* includes a curved edge 170 associated with radiating antenna elements 172*a-f*. The cards 152*a-g* are provided at varying angles about the z-axis 42. The $E_M$ field vector is tangent to the curved edge 170. The pickup antenna elements 176*a-f* are provided on a curved edge 178. Each of the configurations discussed with reference to FIGS. 7-13 provide general elliptical polarization, including Right Hand Circular Polarization (RHCP) and Left Hand Circular Polarization (LHCP).

Figure 14:
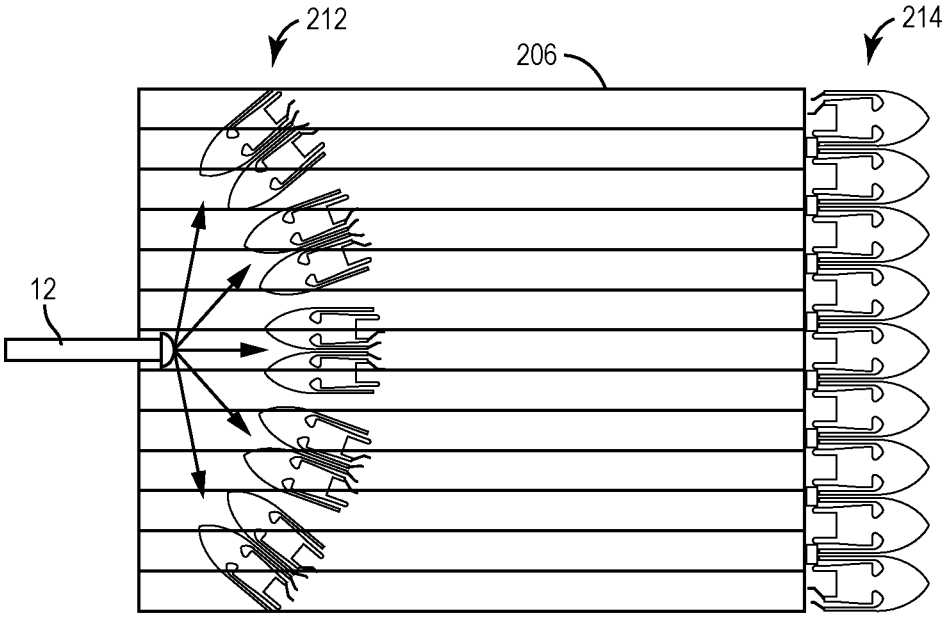
FIG. 14 is a schematic top view planar drawing of one example (using Vivaldi antenna elements) of the cards for use in a planar array spherical feed assembly according to exemplary aspects of the inventive concepts disclosed herein.

With reference to FIG. 14, a planar array subsection of a spherical feed is integrated into a planar AESA aperture according to some embodiments. The feed antenna 12 is provided above, below or in line with a card 206. The card 206 includes pickup elements 212 and radiating antenna elements 214 extending from the card 206. The card 206 includes RF feed lines and TRMs between the pickup elements 212 and radiating antenna elements 214. The pickup antenna elements 212 follow a circular contour within card 206 and a 3-dimensional (D) wave guide connects the pickup antenna elements 212 to the radiating antenna elements 214. In addition, 3D waveguides may incorporate RF T/R modules with bias and control lines routed on the exterior surfaces of the waveguide. The 3-D wave guide connects can be realized utilizing stacked computer CNC milled plates to realize arbitrary 3-D feedback paths, utilizing 3-D additive manufacture or utilizing flexible strip line or PCB and liquid crystal polymer (LCP) technology.

Figure 15:
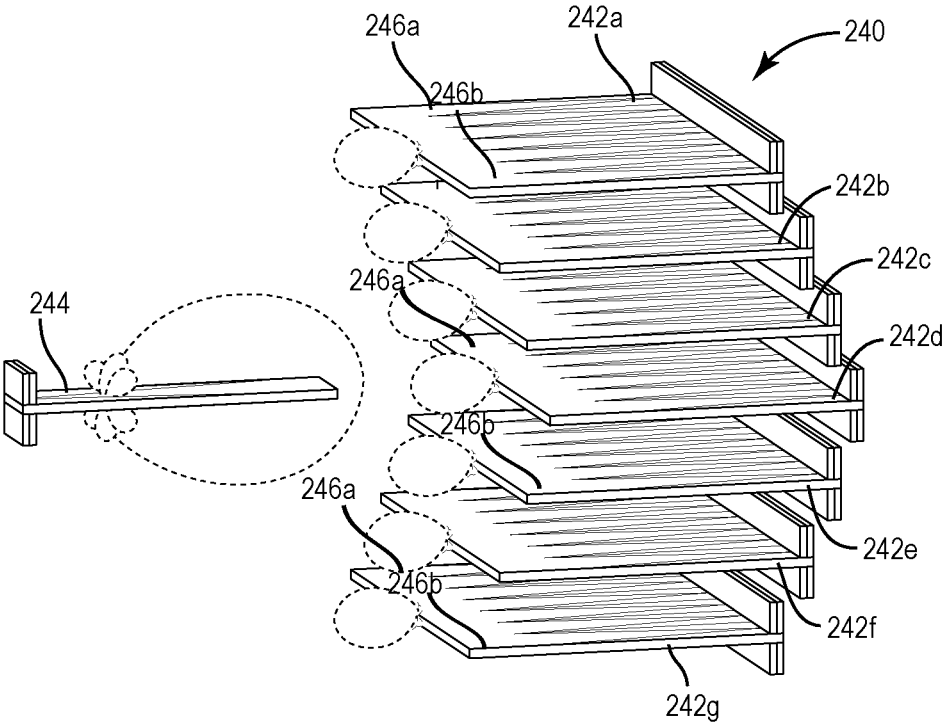
FIG. 15 is a schematic perspective view drawing of planar array spherical space feed integrated into a planar AESA assembly according to exemplary aspects of the inventive concepts disclosed herein.

With reference to FIG. 15, a planar array spherical feed integrated into a planar AESA assembly aperture 240 is shown. The aperture 240 includes cards 242*a-g*. AESA assembly 240 can provide a transmit cosine squared ($COS^2$) pattern. The feed antenna 244 is a horn or any of several different types of antennas that have the appropriate beam width and polarization (e.g., a Vivaldi antenna). FIG. 15 shows a $COS^2$ tapered pattern in the H-Plane of the antenna (with the polarization in the direction of the card). An additional taper can be implemented in the E-plane by varying the elements distances to the feed.

The cards 242*a-g* can be arranged in a spherical space for both the pickup elements and the radiating elements. The cards 242*a-g* are rectangular and staggered in an arc. The power received by the antenna elements on the outside portions 246 *a-b* of the cards 242*a-g* may be less than the power closer to the center, and therefore a natural amplitude taper can be optimized for the vertical plane which is desirable in certain applications.

Figure 16:
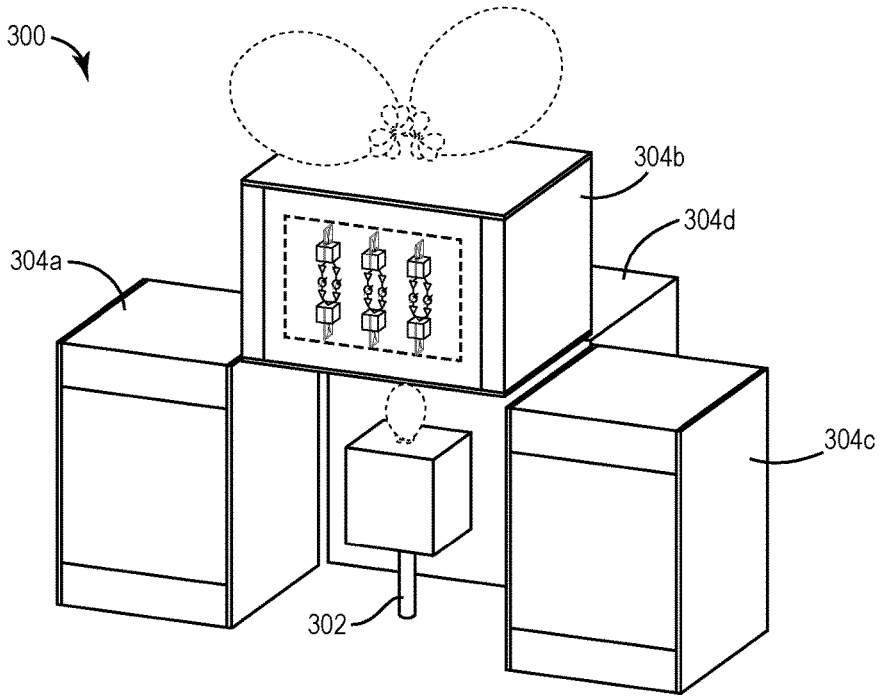
FIG. 16 is a schematic perspective view drawing of a multifaceted space feed assembly according to exemplary aspects of the inventive concepts disclosed herein.

With reference to FIG. 16, a space feed sensor assembly 300 can be configured as a sensor using a central space feed antenna 302 and AESA subarrays 304*a-e*. The central space feed antenna 302 can be comprised of five (or other number) single channel horns or wide beam planar elements. The central space feed antenna 302 is configured for multiple space feeds at the geometric center of the assembly 300 in some embodiments. Each of the co-located multiple space feeds can feed one of the AESA subarrays 304*a-e*. The AESA subarrays 304*a-e* are racked and stacked to provide hemispherical coverage and yet has a less complicated feed architecture.

Each AESA subarray 304*a-e* can utilize one or more of the AESA assemblies described with reference to FIGS. 1-15 and is configured to provide hemispherical or spherical coverage using multiple planar facets in some embodiments. Each AESA subarrays assemblies 304*a-e* includes a set of planar space arrays in some embodiments. Each ASA subarray 304*a-e* includes two-dimensional planar assemblies including TRMs in some embodiments. Each space feed distribution network 304*a-e* includes amplifiers and phase shifters (or time delay units) in some embodiments.

In some embodiments, the assembly 300 is configured as an electromagnetic wave (EW) sensor providing hemispherical coverage with transmit and receive capability. In some embodiments, the transmit and receive sensors can be separable. Each array facet can add two (or more) beams to the system. The six facet approach has six space fed arrays in some embodiments. More facets are possible with each increasing the number simultaneous beams within the system by two, with each beam covering a subsector of the hemisphere. The multiple beam approach is achieved through multiple phase shifters or time delay units on the space feed array and thus multi-beam at separate frequency points is available in some embodiments. Natural space feed $COS^2$ taper is available on the aperture distribution. One side of the assembly 300 is not shown in FIG. 16 to show the central space feed antenna 302.

Figure 17:
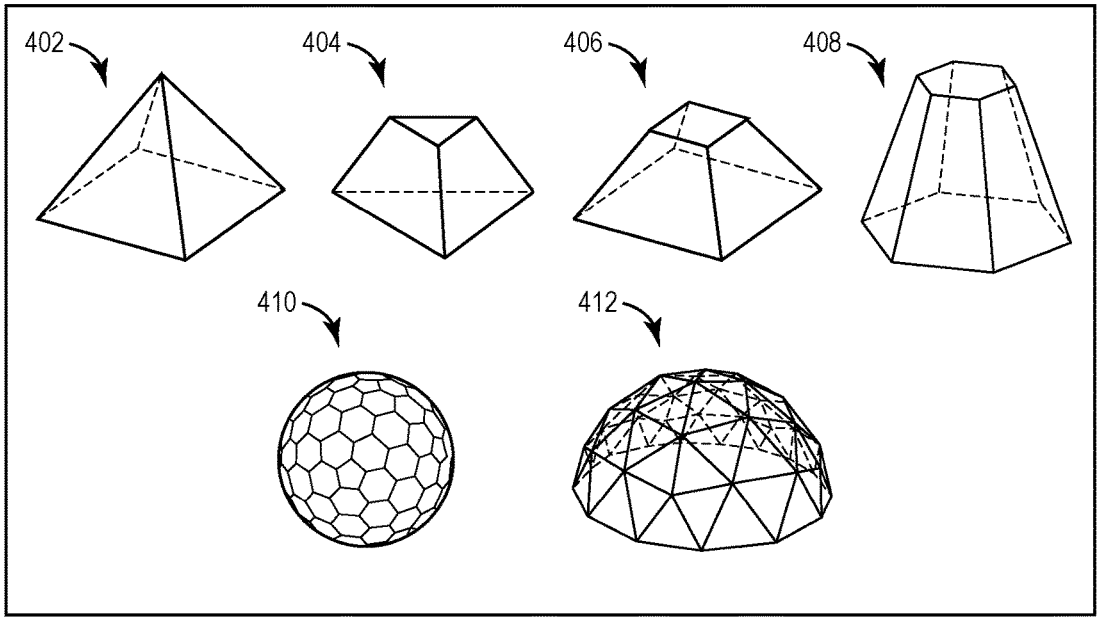
FIG. 17 is a schematic perspective view drawing of examples of hemispherical coverage arrays according to exemplary aspects of the inventive concepts disclosed herein.

With reference to FIG. 17, hemispherical coverages or doubly curved conformal partial spheres are possible using the multiple assemblies 304. For example, a pyramidal coverage 402, a truncated pyramidal coverage 404, a four-sided truncated pyramidal coverage 406, a hexagonal pyramidal coverage 408, a hemispherical coverage 440 and a semi-hemispherical coverage 420? are available. Spherical dome arrays consisting of angular planar facets (e.g., soccer balls, geodesic structures with planar triangular, pentagonal, and hexagonal planar facets are available. End-side pyramidal cluster of structures are also available. Truncating end-side pyramidal structures with a outwardly? looking pattern array faces are available.

TRMS are not shown in FIGS. 3-17 for simplicity. Although particular numbers or cards are shown in the FIGS. 1, 7, and 11, additional cards or less cards can be utilized. Other types of polarization and combinations of polarization configurations are possible depending on design criteria and system parameters.

In some embodiments, one or more alignment structures can be used with the antenna elements and can comprise one or more alignment rods. The antenna array system can further include a plurality of spacers arranged along each of the one or more alignment rods. Each spacer can be configured to separate a respective pair of adjacent metallic structures by a predefined distance. In some embodiments, the one or more alignment structures can include mechanical housing structures that are configured to be mechanically coupled to each other. Each mechanical housing structure can be configured to receive a respective sheet metal structure of the plurality of sheet metal structures or a respective PCB of the PCBs. The metallic structures can be arranged parallel to each other when the mechanical housing structures are mechanically coupled to each other.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna array system comprising:

a feed antenna;

a plurality of circuit boards, each of the circuit boards having a first edge, a second edge portion, a plurality of pickup elements disposed on a curved edge portion of the first edge, a plurality of radiating elements disposed on the second edge portion and a plurality of transmit receive modules disposed between the pickup elements and the radiating elements.

2. The antenna array system of claim 1, wherein the circuit boards are arranged parallel to each other.

3. The antenna array system of claim 1, further comprising one or more alignment structures between the circuit boards.

4. The antenna array system of claim 1, wherein the second edge portion is curved.

5. The antenna array system of claim 1, wherein the pickup elements and the radiating elements are part of a metallic structure.

6. The antenna array system of claim 1, wherein the second edge portion is a straight edge.

7. The antenna array system of claim 1, wherein the radiating elements have a frequency bandwidth including a frequency range at least extending from 18 GHz to 60 GHz.

8. The antenna array system of claim 1, wherein the circuit boards comprise vertically disposed circuit boards and horizontally disposed circuit boards.

9. The antenna array system of claim 8 wherein the horizontally disposed circuit boards_provide a first type polarization and wherein the second edge portion of the horizontally disposed circuit boards_is curved and wherein the vertically disposed circuit boards provide a second type polarization and the second edge portion of the vertically disposed circuit boards is straight.

10. The antenna array system of claim 1, wherein the pickup elements are disposed in a curved arrangement along the curved edge portion of the first edge.

11. A method of manufacturing an array antenna, the method comprising:

providing a plurality of circuit cards having a plurality of first metallic structures configured as pickup antennas and a plurality of second metallic structures configured as radiation antennas; and providing a feed antenna proximate a first edge of the circuit cards, the first edge being associated with the pickup antennas, the pickup antennas being arranged in a curved fashion.

12. The method of claim 11 further comprising providing a transmit receive module on the circuit cards for each of a pair of one of the pickup antennas and one of the radiation antennas.

13. The method of claim 12, further comprising arranging the circuit cards about an axis at varying angles with respect to the axis.

14. The method of claim 13, further comprising:

arranging a first set of the circuit cards about a first axis at varying angles and arranging a second set of the circuit cards at varying angles about a second axis perpendicular to the first axis.

15. The method of claim 14, wherein the first set of the circuit cards is nested with the second set of the circuit cards.

16. An antenna array assembly, the antenna array assembly comprising:

a feed antenna; and a spherical space feed comprising a plurality of circuit boards, each circuit board comprising a plurality of pickup antenna elements disposed in a curved fashion at a first edge of the circuit board, a plurality of radiating antenna elements disposed on a second edge of the circuit board, the first edge being opposite the second edge, and a plurality of transmit receive modules disposed between the pickup antenna elements and the radiating antenna elements on the circuit board, the first edge being a curved edge.

17. A spherical space feed for an antenna array assembly, the spherical space feed comprising:

at least one circuit board comprising plurality of pickup antenna elements disposed in a curved fashion at a first edge of the circuit board, a plurality of radiating antenna elements disposed on a second edge of the circuit board, the first edge being opposite the second edge, and a plurality of transmit receive modules disposed between the pickup antenna elements and the radiating antenna elements on the circuit board, the first edge being a curved edge, wherein a tangent line to the second edge is parallel to an electric field ($E_m$) vector associated with electromagnetic energy associated with the radiating antenna elements.

18. A spherical space feed for an antenna array assembly, the spherical space feed comprising:

at least one circuit board comprising plurality of pickup antenna elements disposed in a curved fashion at a first edge of the circuit board, a plurality of radiating antenna elements disposed on a second edge of the circuit board, the first edge being opposite the second edge, and a plurality of transmit receive modules disposed between the pickup antenna elements and the radiating antenna elements on the circuit board, the first edge being a curved edge, wherein the second edge is a partial circumference defined by a fixed radius.

19. A spherical space feed for an antenna array assembly, the spherical space feed comprising:

at least one circuit board comprising plurality of pickup antenna elements disposed in a curved fashion at a first edge of the circuit board, a plurality of radiating antenna elements disposed on a second edge of the circuit board, the first edge being opposite the second edge, and a plurality of transmit receive modules disposed between the pickup antenna elements and the radiating antenna elements on the circuit board, the first edge being a curved edge, wherein the at least one circuit board comprises a first semicircular circuit board and a second semicircular circuit board disposed perpendicular to the first semicircular circuit board.

20. The spherical space feed of claim 19, wherein a tangent line to the second edge is parallel to an electric field ($E_m$) vector associated with electromagnetic energy associated with the radiating antenna elements.

* * * * *